US006848130B1

(12) United States Patent
Wilson

(10) Patent No.: US 6,848,130 B1
(45) Date of Patent: Feb. 1, 2005

(54) BED WEDGE PAD

(75) Inventor: William H Wilson, 206 Seagrape Ct., Naples, FL (US) 34110

(73) Assignee: William H Wilson, Naples, FL (US)

( * ) Notice: Subject to any disclaimer, the term of this patent is extended or adjusted under 35 U.S.C. 154(b) by 0 days.

(21) Appl. No.: 10/699,554

(22) Filed: Nov. 3, 2003

(51) Int. Cl.[7] ..... A47C 21/08
(52) U.S. Cl. ..... 5/425; 5/732; 5/427; 5/739
(58) Field of Search ..... 5/630, 632, 640, 5/193, 424, 425, 427, 485, 499, 500, 946, 731, 732, 739, 900.5

(56) References Cited

U.S. PATENT DOCUMENTS 3,148,387 A * 9/1964 Sarnie, Jr. et al. ..... 5/632
4,197,603 A * 4/1980 Greenhawk, Sr. ..... 5/630
4,286,344 A * 9/1981 Ikeda ..... 5/717
4,607,412 A * 8/1986 Ashworth ..... 15/230.18
4,872,228 A * 10/1989 Bishop ..... 5/425
4,873,734 A * 10/1989 Pollard ..... 5/425
5,359,739 A * 11/1994 Rains et al. ..... 5/81.1 R
5,754,998 A * 5/1998 Selton ..... 5/652
6,088,858 A * 7/2000 Juster et al. ..... 5/737

* cited by examiner

*Primary Examiner*—Michael Trettel

(57) ABSTRACT

A bed pad wedge system for inhibiting a person from falling out of bed. The system includes a fitted mattress pad fastened to a mattress. Each lateral edge of the fitted pad has pockets located therein that contain foam rubber wedges having the shape of an obtuse triangle. The pockets are installed on an underside of the fitted pad and are facing an outer edge of the mattress. The triangular foam rubber wedges are each encased in a slippery material to aid in installing the wedges in the pockets. A third wedge or triangle may be installed in the middle of a mattress between the outer wedges that are located at each edge of the mattress. The wedge system may be covered by standard sheets and bedding.

6 Claims, 2 Drawing Sheets

BED WEDGE PAD

BACKGROUND OF THE INVENTION

The invention involves an accessory to a standard size bed or other beds such as queen size or king size. The accessory involves significant barriers at each lateral edge of a mattress or a barrier placed in the middle of a large mattress. The accessory is in the form of a wedge, triangle or other shape as desired, at each lateral side of a mattress to help prevent a person from falling out of the bed. This is especially important in rest homes where the side railings of any bed cannot be left in an upstanding position. These beds are occupied by an impaired person that can still enter or exit a bed by themselves and still has a tendency to inhibit that person from falling out of bed, or a child moving from a crib to a standard bed. This system allows easy entrance or exit from the bed, without altering the barriers.

U.S. Pat. No. 4,607,402 illustrates a retainer sheet for a mattress in which extra tunnels are sewn to the top of the sheet into which round foam pieces are inserted to prevent a person from falling out of the bed or exiting the bed without assistance. It is necessary to remove the foam pieces to allow exit from the bed.

U.S. Pat. No. 3,148,387 shows a support attachment for a sleeping surface. The sleeping surface consists of a fitted bed sheet that has foam support members attached to lateral sides of the sheet. The support members are encased in a covering and the ends of this configuration are attached to the sheet by way of zippers. The longitudinal edges of the covering are not attached to the fitted sheet. However, the foam cores are reinforced in their longitudinal extent by steel rods embedded therein.

U.S. Pat. No. 4,754,509 is a disclosure similar to the above-identified patent and does not add anything to applicant's inventive concept.

U.S. Pat. No. 4,800,600 illustrates a crib bumper device that is not fastened to any sheet thereunder but is held in place by slats of the sides of the crib.

U.S. Pat. No. 4,872,228 shows a bed guard that consists of bolsters that are simply held in place by a conventional bed sheet that is draped over the bolsters and then tucked under the mattress. There are no seams to hold the bolsters in place at the edge of the mattress.

U.S. Pat. No. 5,351,348 shows a rest pad for an infant. The guard is constructed of a top sheet that has continuous tunnels at each end into which tunnels inflatable tubes are inserted that form the bumper material.

U.S. Pat. No. 5,754,998 illustrates a therapeutic bedding pad consisting of a one piece foam material having a resting area in the middle and bumpers at the sides.

SUMMARY AND OBJECTS OF THE INVENTION

The invention at hand consists of a pad, which is separate from the mattress to which it is attached. The pad is the well known fitted pad which covers the top of a mattress continues around the sides and then is fastened on the underside of the mattress by either elastic seams or pull cords contained in a hem. The object of the invention is to create a mattress pad that has pockets attached at the lateral sides of the pad. This will prevent or inhibit an occupant of the bed from falling out of the bed, and a secure feeling to guide a person to the center of the bed, but still giving the occupant the ability to get out of bed. The pockets are constructed in such a manner so that the wedges cannot be pushed aside by the occupant of the bed, or require removing the wedge to exit the bed as is required in other references cited above. It is also possible to install a center foam barrier in the pad cover of the mattress that is a suggestion of two separate sleeping areas. In this manner, when two persons are occupying the same bed, they will not interfere with each other while sleeping and at the same time still being inhibited from falling out of the bed. The option of using these inserts is determined by the user.

DETAILED DESCRIPTION OF THE INVENTION

Figure 1:
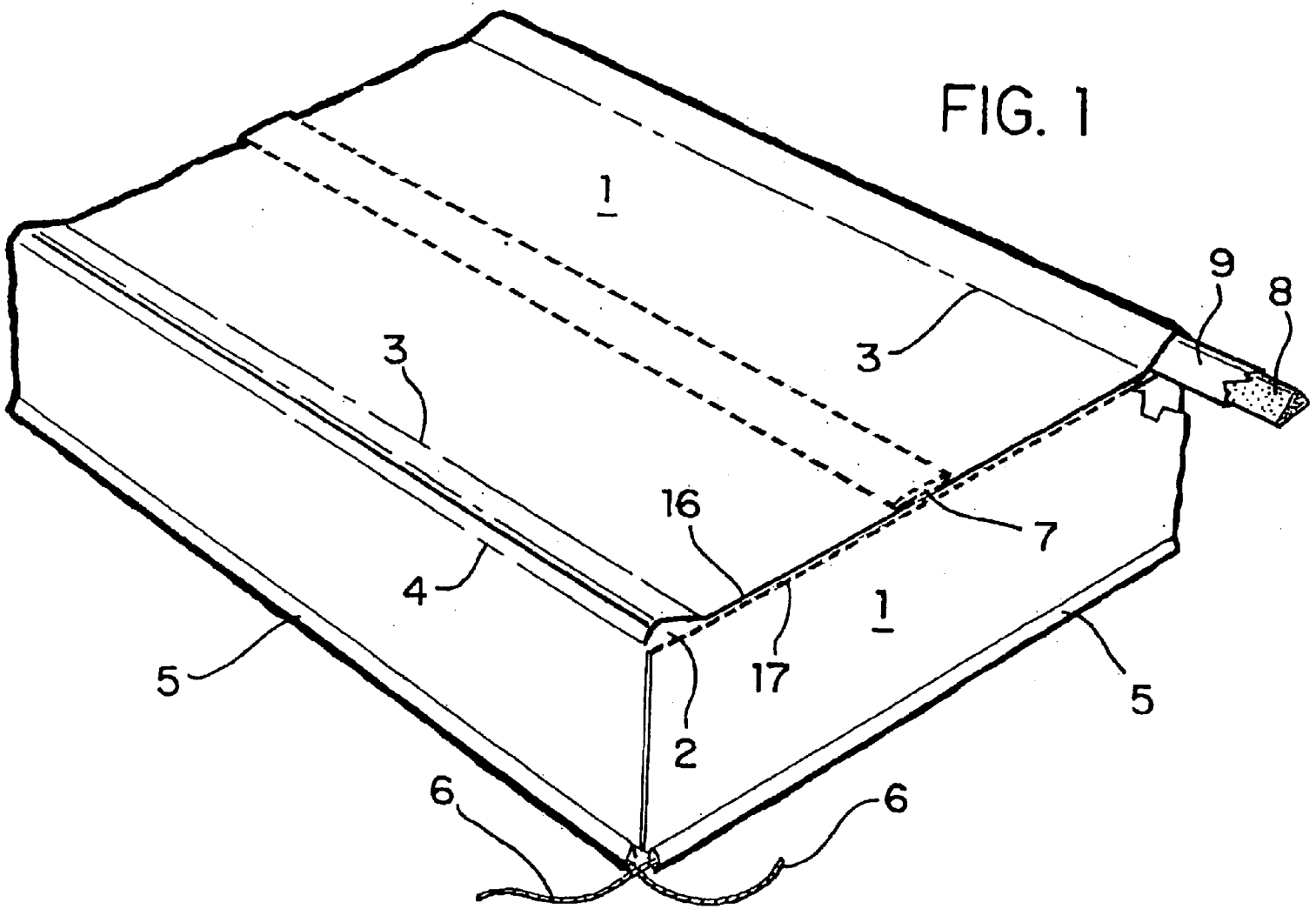
FIG. 1 is a perspective view of a mattress having a fitted mattress pad installed thereon with wedges installed therein.

Turning now to FIG. 1, which, as was noted above, is a perspective view of a mattress having a fitted mattress pad with wedges therein installed thereon. The overall mattress pad is denoted as 1 having a forward edge 16. As can be seen on the front wall of the perspective view, there are pockets 2 provided into which the profiled wedges 8 are inserted. The pockets 2 are sewn to the fitted pad or mattress cover 1 from the reverse side. An extra sheet 17 of bedding material is used for this purpose. A first seam 4 secures the extra sheet 17 right at the edge where the extra sheet 17 meets with the edge of the mattress. A second seam 3 secures the extra sheet 17 to the fitted pad 1: at a location that is away from the edge of the mattress and by allowing access material, the pocket 2 is formed. This operation can now be performed on the opposite side of the mattress pad to form the second pocket. As mentioned above, the sewing operation of fitted sheet 17 is performed on the inside of the mattress pad 1 to hide the pockets in the interior of the fitted mattress pad 1 to prevent the wedges from working out of the pocket and for aesthetic reasons. Also a further pocket can be installed in the middle of the fitted mattress pad as is shown at 7. This enables two persons to sleep on a larger mattress without interfering with each other while creating two sleeping surfaces and still inhibit falling out of the bed. Of course, there is a wide choice that can be made as to a selection of the profiles of the foam rubber. The illustrated shape 8 of an obtuse triangle is preferred but is not limited to that shape. Experimentation has shown that this shape is best suited for the intended purpose. The fitted mattress pad is well known and is fastened to the underside of the mattress by pull cords 6 which are contained in the hem 5. Other fastening systems are also well known such as elastic bands. Also shown in FIG. 1 is a casing 9 for the foam rubber wedge 8. The casing 9 should consist of a somewhat slippery material such as taffeta. This is important, because once the pockets 2 and 7 are created, the foam rubber wedges 8 have and should have a somewhat tight fit. In this instance, it will be difficult to insert the wedges 8 into the pockets 2 and 7 because of the frictional characteristics of the foam's outer surface. The slippery material of the casing 9 will greatly aid in this endeavor.

Figure 2:
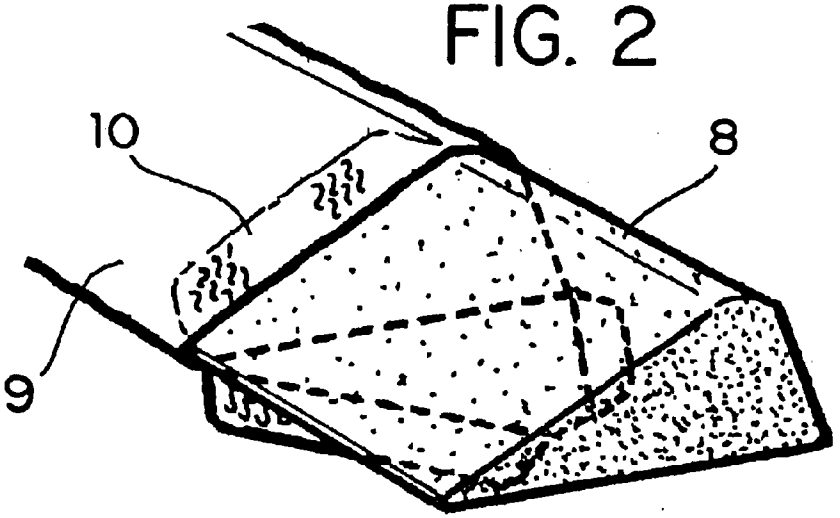
FIG. 2 illustrates a foam rubber wedge being encased in a casing.

FIG. 2 illustrates how the foam wedge 8 is inserted into casing 9. The casing 9 on its upper side having part 10 of the hook and loop system sewn or otherwise attached thereto.

Other closing systems are also well known such as snaps, or a flap tuck such as a sandwich bag (not shown).

Figure 3:
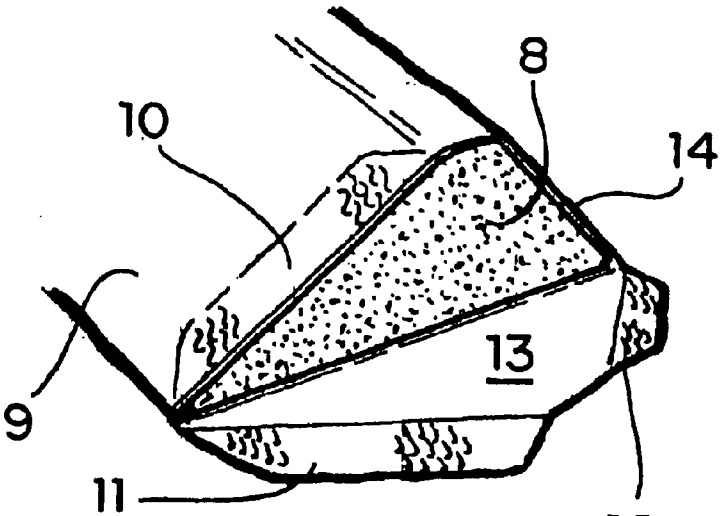
FIG. 3 shows how the wedge casing of FIG. 2 is closed at its end.

FIG. 3 shows one type of the closing system for the foam casing 9. The casing 9 has a flap 13 having fasteners 11 and 12 of the hook and loop system sewn or otherwise attached thereto. Once the foam wedge 8 is completely inserted into the casing 9, the flap 13 having the fasteners 11 and 12 thereon will be brought up to match the fasteners 10 and 14 respectively (14 not shown) on casing 9. The hook and loop system again has one part fasteners 10 and 14 (14 not shown) attached to the outside of casing 9. Once the flap 13 is brought over the end of the foam casing, 10 and 11 will meet and close the foam casing. Also 12 and 14 (14 not shown) will meet and close this fastener on the other side of the triangle of casing 9.

Figure 4:
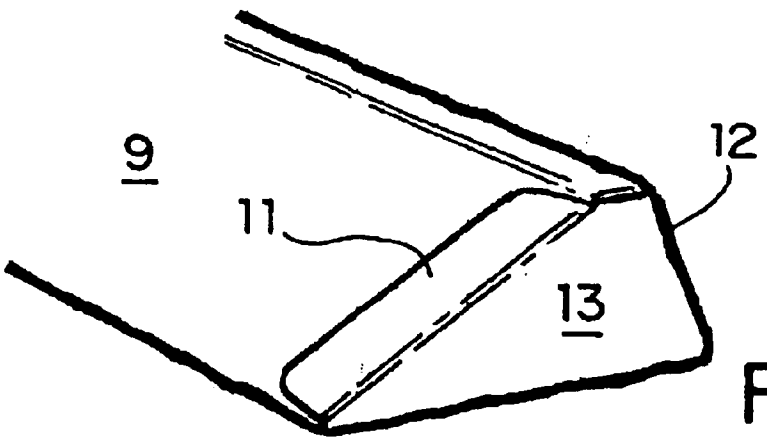
FIG. 4 shows how the end of the wedge casing as it is closed with the wedge located therein.

FIG. 4 illustrates how the triangular casing 9 is closed with flap 13 and the two fasteners 11 and 12 (12 not shown) are secure.

What I claim is:

1. A bed pad wedge system including a wedge installed at each lateral edge of a fitted mattress pad, as a guard, comprising a fitted mattress pad enclosing a mattress and fastened thereto, said mattress pad including two pockets each fastened to said mattress pad at each lateral edge of said mattress pad, said pockets are installed on the underside of said mattress pad facing an outer surface of said mattress pad, said pockets are each formed by a first seam located at an edge of said mattress pad and a second seam located inside of said mattress pad and away from said first seam at the edge of said mattress, a foam rubber wedge is located in each of said pockets.

2. The bed pad wedge system of claim 1 including a third pocket located in the middle of said mattress pad between each of said edges of said mattress pad.

3. The bed pad wedge system of claim 1 wherein each of said wedges has the shape of an obtuse triangle.

4. The bed pad wedge system of claim 1, wherein each of said foam rubber wedges is encased in a slippery material.

5. The bed wedge system of claim 4, wherein each end of said wedges encased in said slippery material has means for closing said ends.

6. The bed pad wedge system of claim 1 including means for closing each end of said packets.

* * * * *